US010716983B2

(12) United States Patent
Kennedy et al.

(10) Patent No.: US 10,716,983 B2
(45) Date of Patent: Jul. 21, 2020

(54) LACROSSE HEAD

(71) Applicant: Cascade Maverik Lacrosse, LLC, Exeter, NH (US)

(72) Inventors: Steven Kennedy, Niskayuna, NY (US); Nicholas Colville, Syracuse, NY (US); Jesse Newman, Liverpool, NY (US); Jefferey Colburn, Baltimore, MD (US); David Williams, Fulton, NY (US)

(73) Assignee: Cascade Maverik Lacrosse, LLC, Exeter, NH (US)

( * ) Notice: Subject to any disclaimer, the term of this patent is extended or adjusted under 35 U.S.C. 154(b) by 0 days.

(21) Appl. No.: 15/201,340

(22) Filed: Jul. 1, 2016

(65) Prior Publication Data

US 2018/0001168 A1 Jan. 4, 2018

(51) Int. Cl.

| | |
|---|---|
| ***A63B 59/20*** | (2015.01) |
| ***A63B 65/12*** | (2006.01) |
| ***A63B 102/14*** | (2015.01) |

(52) U.S. Cl.

CPC ..... *A63B 59/20* (2015.10); *A63B 65/122* (2013.01); *A63B 2102/14* (2015.10)

(58) Field of Classification Search

CPC ..... A63B 59/02

USPC ..... 473/513

See application file for complete search history.

(56) References Cited

U.S. PATENT DOCUMENTS

| | | | | |
|---|---|---|---|---|
| 5,566,947 | A * | 10/1996 | Tucker | A63B 49/10 473/513 |
| 6,921,347 | B1 * | 7/2005 | Morrow | A63B 60/50 473/513 |
| 2002/0173388 | A1 * | 11/2002 | Morrow | A63B 59/30 473/513 |
| 2004/0053714 | A1 * | 3/2004 | Gait | A63B 59/20 473/513 |
| 2007/0060423 | A1 * | 3/2007 | Morrow | A63B 59/20 473/513 |
| 2007/0072708 | A1 * | 3/2007 | Reeb | A63B 53/20 473/513 |
| 2009/0011874 | A1 * | 1/2009 | Gait | A63B 60/00 473/513 |

(Continued)

OTHER PUBLICATIONS

[No Author Listed] Warrior Lacrosse Tweet, dated Apr. 3, 2015. https://twitter.com/warriorlacrosse/status/584067957052936192 [last accessed Nov. 3, 2016].

(Continued)

*Primary Examiner* — Eugene L Kim
*Assistant Examiner* — Christopher Glenn
(74) *Attorney, Agent, or Firm* — Wolf, Greenfield & Sacks, P.C.

(57) ABSTRACT

Aspects disclosed herein relate to lacrosse heads and sidewalls thereof. The sidewalls include struts which reduce weight and/or reduces stresses which can lead to fatigue failure. In some embodiments, two struts are arranged on the sidewall such that they abut each other and have a similar angle in the ball stop end to scoop end direction of the sidewall, but the two struts cross over each other in a side-to-side direction. When force is applied in a certain direction, one of the struts may be primarily in compression, while its companion strut may be primarily in tension.

15 Claims, 10 Drawing Sheets

(56) References Cited

U.S. PATENT DOCUMENTS

| | | | | |
|---|---|---|---|---|
| 2009/0298623 | A1* | 12/2009 | Schmidt | A63B 60/38 473/513 |
| 2011/0218060 | A1* | 9/2011 | Vestuti | A63B 59/20 473/513 |
| 2015/0011341 | A1* | 1/2015 | Janisse | A63B 60/00 473/513 |

OTHER PUBLICATIONS

[No Author Listed] YouTube Video. Warrior Evo4x Pattern: ECM Black, published Dec. 31, 2014. https://www.youtube.com/watch?v=PReUROpwsgl (.mp4 file; DVD enclosed) [last accessed Nov. 2, 2016].

[No Author Listed] YouTube Video. Warrior Burn Lacrosse Head, published Oct. 31, 2014. https://www.youtube.com/watch?v=wRCK tZ8g5c (.mp4 file; DVD enclosed) [last accessed Nov. 2, 2016].

* cited by examiner

LACROSSE HEAD

FIELD

Aspects of the disclosure relate generally to lacrosse heads and more specifically to struts for lacrosse head sidewalls.

DISCUSSION OF RELATED ART

Lacrosse head sidewalls typically include a top rail and a bottom rail. In many lacrosse heads, one or more struts connect the top rail to the bottom rail to provide rigidity to the head.

SUMMARY

According to one embodiment, a lacrosse head includes a scoop end, a ball stop end, and first and second sidewalls, wherein the first sidewall includes a first top rail and a first bottom rail. A first strut is connected to the first top rail and the first bottom rail, the first strut having a longitudinal axis. A second strut is connected to the first top rail and the first bottom rail, the second strut having a longitudinal axis, the first and second struts being directly connected along at least a portion of their lengths. the lacrosse head has a vertical centerline plane which extends longitudinally from the ball stop end to the scoop end. An orthogonal projection of the longitudinal axes of the first and second struts onto the vertical centerline plane results in two projection lines which are substantially parallel to one another, and the longitudinal axes of the first and second struts are not parallel to one another.

According to another embodiment, a lacrosse head includes a scoop end, a ball stop end, and first and second sidewalls. The first sidewall includes a top rail and a bottom rail, the first sidewall top rail has a top rail inner surface, and the sidewall bottom rail has a bottom rail inner surface. The lacrosse head having a vertical centerline plane which extends longitudinally from a the ball stop end to the scoop end. A first unitary strut is connected to the top rail and the bottom rail, the first unitary strut having first and second inwardly-facing surfaces facing generally toward the vertical centerline plane. The first inwardly-facing strut surface connects to the top rail at a first connection location and connects to the bottom rail at a second location. The first connection location is positioned outwardly from the top rail inner surface by a distance $d_1$. The second connection location is positioned either at the bottom rail inner surface or outwardly from the bottom rail inner surface by a distance $d_2$ that is less than distance $d_1$. The second inwardly-facing strut surface connects to the top rail at a third connection location and connects to the bottom rail at a fourth connection location. The fourth connection location is positioned outwardly from the bottom rail inner surface by a distance $d_4$. The third location is positioned either at the top rail inner surface or outwardly from the top rail inner surface by a distance $d_3$ that is less than distance $d_4$.

According to a further embodiment, a lacrosse head includes a scoop end, a ball stop end, and first and second sidewalls, wherein the first sidewall includes a top rail and a bottom rail, the sidewall top rail has a top rail inner surface, and the sidewall bottom rail has a bottom rail inner surface. The lacrosse head has a vertical centerline plane which extends longitudinally from the ball stop end to the scoop end. Also included is a first strut connected to the top rail and the bottom rail, wherein the first strut connects to the top rail at a first connection location and connects to the bottom rail at a second location. The first connection location is positioned outwardly from the top rail inner surface relative to the vertical centerline plane. A second strut is connected to the top rail and the bottom rail, wherein the second strut connects to the top rail at a third connection location and connects to the bottom rail at a fourth location. The fourth connection location is positioned outwardly from the bottom rail inner surface relative to the vertical centerline plane. The first and second struts are directly connected to one another within zero to five millimeters of the top rail and within zero to five millimeters of the bottom rail.

According to yet another embodiment, a lacrosse head includes a scoop end, a ball stop end, and first and second sidewalls, wherein the first sidewall includes a top rail and a bottom rail, the sidewall top rail has a top rail inner surface, and the sidewall bottom rail has a bottom rail inner surface. The lacrosse head has a vertical centerline plane extending longitudinally from the ball stop end to the scoop end. Also included is a first strut connected to the top rail and the bottom rail, wherein the first strut connects to the top rail at a first connection location and connects to the bottom rail at a second location. The first connection location is positioned outwardly from the top rail inner surface relative to the vertical centerline plane. A second strut is connected to the top rail and the bottom rail, wherein the second strut connects to the top rail at a third connection location and connects to the bottom rail at a fourth location. The fourth connection location is positioned outwardly from the bottom rail inner surface relative to the vertical centerline plane. The first strut has a length extending from the first connection location to the second connection location, and the first strut is connected to the second strut along at least fifty percent of the length of the first strut.

According to a further embodiment, a lacrosse head includes a scoop end, a ball stop end, and first and second sidewalls, wherein the first sidewall includes a top rail and a bottom rail, the sidewall top rail has a top rail inner surface, and the sidewall bottom rail has a bottom rail inner surface. The lacrosse head having a vertical centerline plane extending longitudinally from the ball stop end to the scoop end. A first strut is connected to the top rail and the bottom rail, wherein the first strut connects to the top rail at a first connection location and connects to the bottom rail at a second location. The first connection location is positioned outwardly from the top rail inner surface relative to the vertical centerline plane. A second strut is connected to the top rail and the bottom rail, wherein the second strut connects to the top rail at a third connection location and connects to the bottom rail at a fourth location. The fourth connection location is positioned outwardly from the bottom rail inner surface relative to the vertical centerline plane. At least one of the first and second struts has a top surface that is both upwardly-facing and forwardly-facing, and that is flat from an innermost edge of the at least one of the first and second struts to an outermost edge of the at least one of the first and second struts.

According to another embodiment, a lacrosse head includes a scoop end, a ball stop end, and first and second sidewalls, wherein the first sidewall includes a top rail and a bottom rail, the sidewall top rail has a top rail inner surface, and the sidewall bottom rail has a bottom rail inner surface. The lacrosse head has a vertical centerline plane extending from the ball stop end to the scoop end. A first strut is connected to the top rail and the bottom rail, wherein the first strut connects to the top rail at a first connection location and connects to the bottom rail at a second location. The first connection location is positioned outwardly from the top rail inner surface relative to the centerline plane. A second strut is connected to the top rail and the bottom rail, wherein the second strut connects to the top rail at a third connection location and connects to the bottom rail at a fourth location. The fourth connection location is positioned outwardly from the bottom rail inner surface relative to the centerline plane. At least one of the first and second struts has a bottom surface which is both downwardly-facing and rearwardly-facing surface, and that is flat from an innermost edge of the at least one of the first and second struts to an outermost edge of the at least one of the first and second struts.

BRIEF DESCRIPTION OF DRAWINGS

The accompanying drawings are not intended to be drawn to scale. In the drawings, each identical or nearly identical component that is illustrated in various figures may be represented by a like numeral. For purposes of clarity, not every component may be labeled in every drawing. Various embodiments of the invention will now be described, by way of example, with reference to the accompanying drawings, in which.

DETAILED DESCRIPTION

Figure 1:
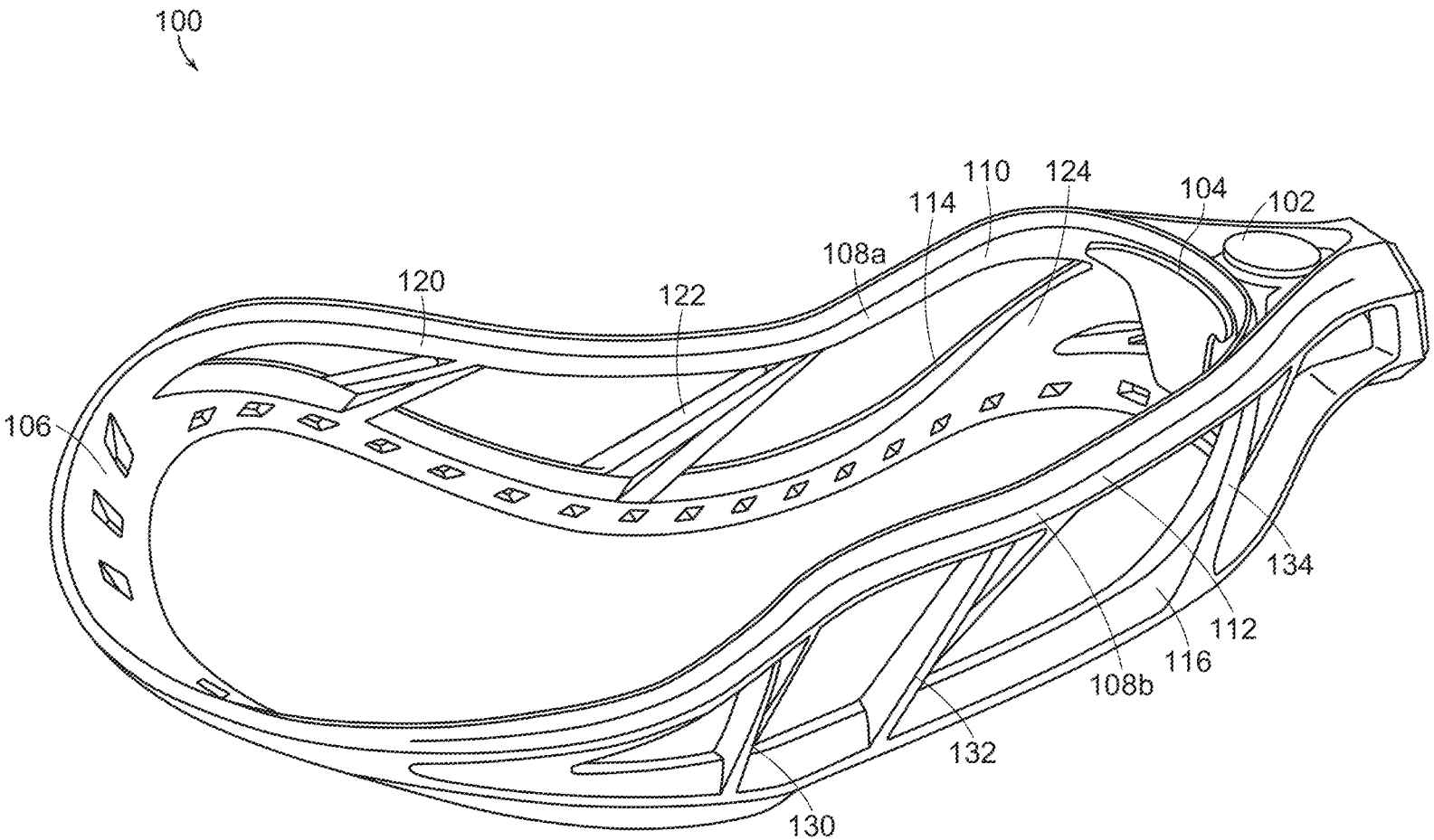
FIG. 1 is a top perspective view of a lacrosse head according to one embodiment.

Aspects of the invention are described herein with reference to certain illustrative embodiments and the figures. The illustrative embodiments described herein are not necessarily intended to show all aspects of the invention, but rather are used to describe a few illustrative embodiments. Thus, aspects of the invention are not intended to be construed narrowly in view of the illustrative embodiments. In addition, it should be understood that aspects of the invention may be used alone or in any suitable combination with other aspects of the invention.

A lacrosse head typically includes a throat for connection to a shaft, a ball stop region distal to the throat, and a scoop region at the far end of the head. Sidewalls connect the ball stop region to the scoop region. A pocket is attached to the head, typically by tying strings of the pocket to holes in the lacrosse head.

The support structure of the head is subject to various stresses during use. For example, catching, shooting, and passing the ball place compressive, tensile, and shear forces on components of the lacrosse head. Additionally, poke checking and other actions can also stress the lacrosse head components.

Sidewalls typically include a top rail and a bottom rail with the pocket connected to the bottom rail. In many lacrosse heads, one or more struts connect the top rail to the bottom rail to provide additional rigidity to the head.

During certain actions, such as shooting, some of the struts may primarily undergo tension, while others of the struts may primarily experience compression. According to embodiments of the disclosure herein, a tension strut is combined with a compression strut to form a combined strut extending between the top rail and the bottom rail; the combined strut being subject to both compressive and tensile forces. In some cases, the two struts are connected to one another at least near the top and/or bottom rails to reduce the number of regions where stress concentrations may be present. For example, stress may be concentrated at the connection location of a strut to a top rail where the strut transitions into the rail. By having a combined strut instead of two separated struts, the total perimeter of the transition region can be reduced, which may reduce the number of locations having the potential for fatigue stress and possible fatigue failure.

According to some embodiments of the present disclosure, a strut geometry is provided wherein the volume of material is reduced without unduly affecting the structural properties of the head. In some cases, various properties of the head, including the rigidity, may be improved. All else being equal, reducing the weight of a lacrosse head can be desirable to improve the speed and maneuverability that a player can achieve when handling a lacrosse stick. Reductions in weight can be achieved through the use of lightweight materials and/or by reducing the volume of material used in the lacrosse head. These approaches need to be balanced with other factors such as strength, durability, and stiffness, as some examples.

In some embodiments, two sidewall struts are connected to one another along their lengths. The two struts are arranged to have similar angles in the ball stop to scoop direction, and have one strut turned relative to the other in a side-to-side direction of the lacrosse head such that the struts cross one another. In embodiments illustrated herein, the struts cross each other, and in some cases contact each other, but they are not necessarily co-planar; one strut may be positioned distal to the other. That is, one strut may be positioned closer to the scoop end of the head than the other strut. One of the struts may resist primarily compressive forces while the other of the struts may resist primarily tension forces. By connecting the two struts as a unitary strut, the two struts reinforce one another which may reduce failure risk and/or reduce weight, while providing sufficient rigidity to the head.

FIG. 1 shows a lacrosse head 100 with a throat region 102, a ball stop 104, and a scoop 106. First and second sidewalls 108*a*, 108*b* extend from the ball stop 104 to the scoop 106, and each sidewall includes a top rail 110, 112 and a bottom rail 114, 116. Unitary struts are positioned along each sidewall and connect the top rails to the bottom rails, and provide rigidity to the head. A first unitary strut 120 is located on first sidewall 108*a* toward a distal end of the head near the scoop. A second unitary strut 122 is positioned at approximately a transition point where the sidewalls start spreading more rapidly outwardly from an imaginary vertical centerline plane as the sidewall travels from the proximal end to the distal end. A third unitary strut 124 connects top rail 110 to bottom rail 114 at a proximal end of the head near the ball stop 104. Similar unitary struts 130, 132, and 134 are present on the opposite sidewall 108*b*.

For clarity of description, two portions of a unitary strut may be referred to herein as first and second struts. For example, unitary strut 122 has a first portion that includes a first inwardly-facing surface 141, and a second portion that includes a second inwardly-facing surface 142. These first and second portions may be referred to as first and second struts 127, 128. For purposes herein, calling out first and second struts does not necessarily mean that the first and second struts are separated by a distance from one another longitudinally. Instead, the first and second struts may form a unitary strut whereby the first and second strut directly connect to one another. The unitary strut may be integrally formed in some embodiments, or two struts may be separately formed and joined together. In some embodiments, a unitary strut may include first and second struts which directly contact one another only close to the top and/or bottom rails. In other embodiments, first and second struts may be non-unitary struts in that they are distinct struts which do not directly contact one another. In some embodiments, three or more struts may be directly connected to form a unitary strut.

First and second struts of a unitary strut may be directly connected along at least 50% of the length of one of the struts in some embodiments. In some embodiments, the direct connection extends along at least 60% of the length of one of the struts. In some embodiments, 70% of the length of at least one of the struts is directly connected to the other of the struts. And, in some embodiments, the struts may be directly connected along the entire length of at least one of the struts. For purposes herein, the length of a strut extends from its highest connection point at the bottom rail to its lowest connection point at the top rail.

Figure 2:
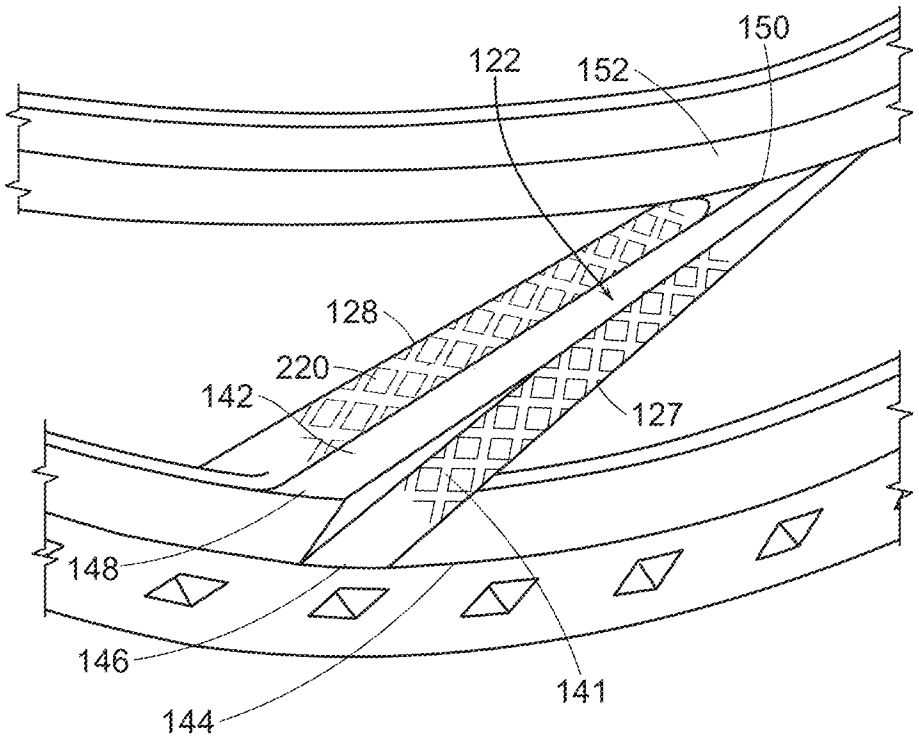
FIG. 2 shows the inner surfaces of one of the struts shown in FIG. 1.

An isolated view of unitary strut 122 is shown in FIG. 2. According to some embodiments of the present disclosure, unitary strut 122 includes first and second inwardly-facing surfaces 141, 142 which have different angles relative to each other. For example, first inwardly-facing surface 141 slants away from the vertical centerline plane when traveling from the bottom rail to the top rail, whereas second inwardly-facing surface 142 slants toward the vertical centerline plane along its path from the bottom rail to the top rail. In some embodiments, both the first and second inwardly-facing surfaces may be angled toward the vertical centerline plane, but at different angles from one another. Or, both inwardly-facing surfaces may slant away from the vertical centerline plane from the bottom rail to the top rail, also at different angles from one another. In other embodiments, an opposite arrangement may be employed where the inwardly-facing surface 142 that is closer to the scoop end slants outwardly and the inwardly-facing surface 141 that is closer to the ball stop end slants inwardly. For purposes herein, any reference to a longitudinally-extending, vertical centerline plane or other plane is an imaginary construct based on the structure of the relevant components by which the plane is defined.

The second inwardly-facing surface 142 has an inner connection location 148 at the bottom rail which is set back from an inner surface 144 of the bottom rail farther than an inner connection location 146 of the first inwardly-facing surface 141 on the bottom rail. The inner connection location 148 of second inwardly-facing surface 142 is also set back from inner surface 144 of the bottom rail by a greater distance than the setback distance of an inner connection location 150 of the same surface (second inwardly-facing surface 142) from an inner surface 152 the top rail. In the illustrated embodiment, the inner connection location 150 at the top rail is at the inner surface of the top rail such that the setback distance is zero, though in some embodiments, the inner connection location 150 may be set back from the inner surface by a distance greater than zero.

A surface texture is provided on inwardly-facing surfaces 141, 142 in the illustrated embodiment. This surface texture is formed as part of the injection molding manufacturing process, though a surface texture may be added after molding in any suitable manner. In some embodiments, no surface texture is present on the inwardly-facing surfaces.

Figure 3:
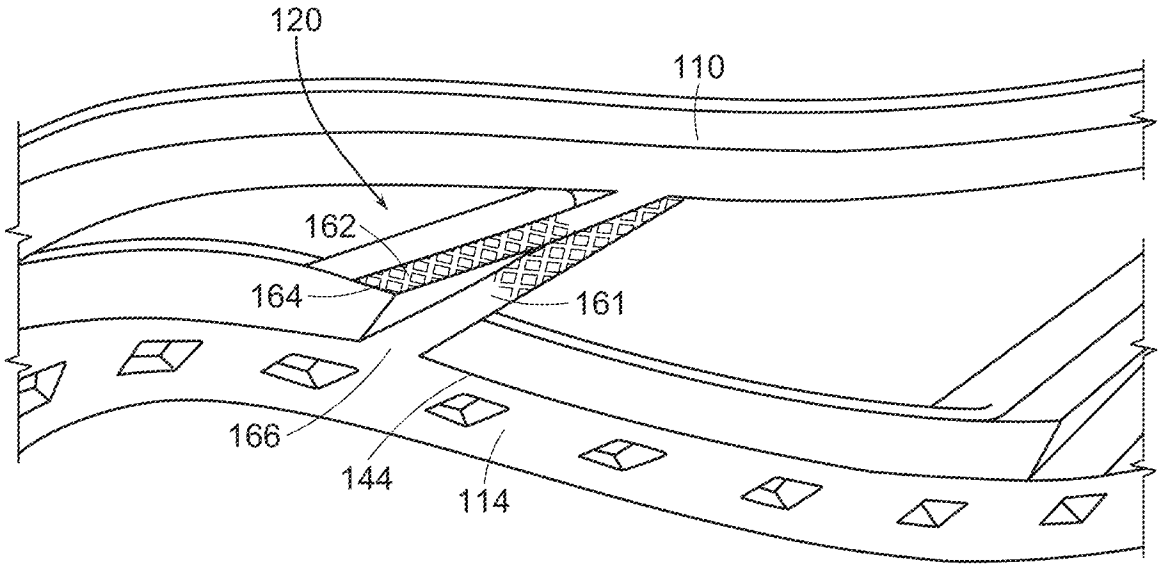
FIG. 3 shows the inner surfaces of one of the distal struts shown in FIG. 1.
Figure 9:
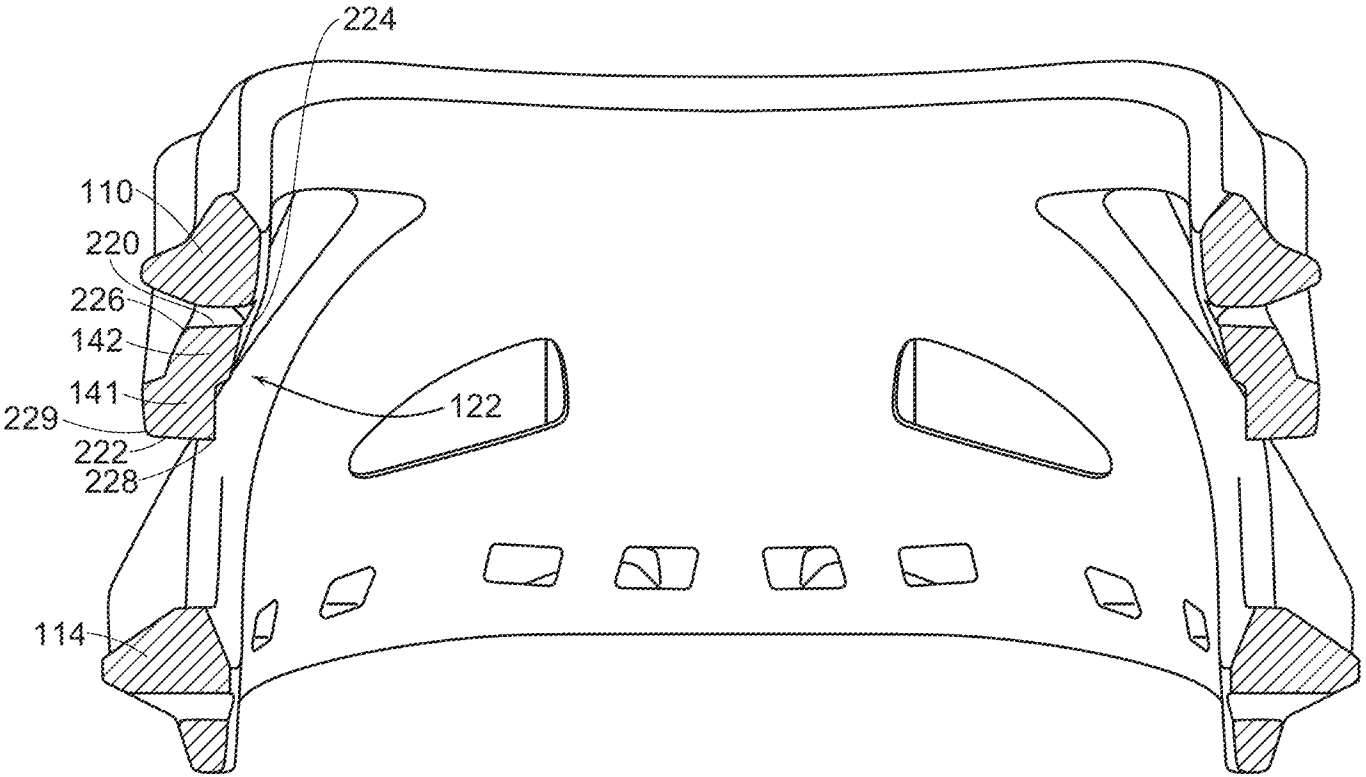
FIG. 9 is a cross-section view of a strut arrangement according to one embodiment.

FIG. 3 shows unitary strut 120 which is positioned toward the distal, scoop end of the head. Similar to strut 122, strut 120 has first and second inwardly-facing surfaces 161, 162. Second inwardly-facing surface 162 has a connection location 164 which is set back from the bottom rail inner surface 144 by a distance of greater than zero. By doing so, the amount of material used is reduced as compared to a strut which is otherwise similar but extends all the way to the bottom rail inner surface. The setback distance of a connection location is defined as the distance from the connection location to a vertical plane tangent to the rail inner surface at the longitudinal location of the connection location along the rail. See FIG. 9 for a diagram with reference to unitary strut 122.

At the top end of strut 120, the second inwardly-facing surface 162 connects to top rail 110 at the inner surface of top rail 110. In some embodiments, the second inwardly-facing surface 162 connects to the top rail at a location which is set back from the inner surface of the top rail, but at a distance less than the distance between connection location 164 and inner surface 144 at the bottom rail.

Figure 4:
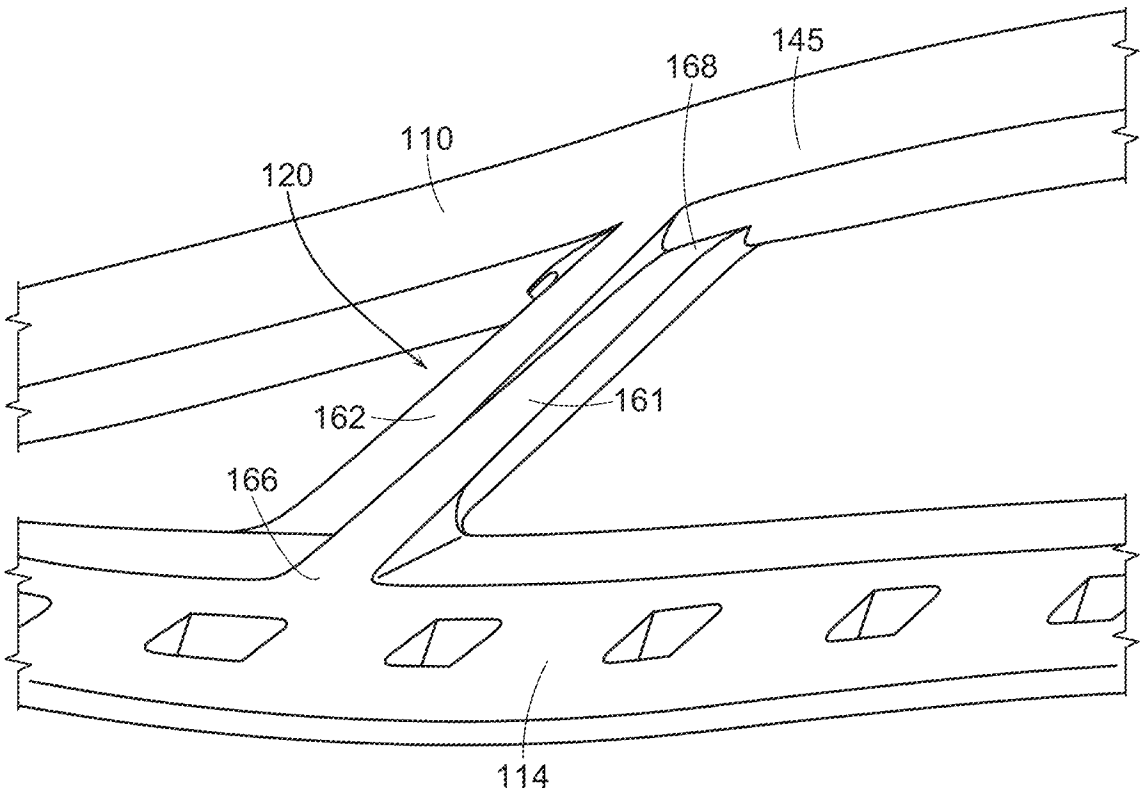
FIG. 4 shows a bottom perspective view of the distal struts shown in FIG. 3.

First inwardly-facing surface 161 connects to bottom rail 114 at a connection location 166 which is at the inner surface of the bottom rail. As can be seen in FIG. 4, which is a perspective view of distal strut 120 from the bottom side of the head, first inwardly-facing surface 161 connects to the top rail at a connection location 168 which is set back by a distance from the inner surface 145 of top rail 110. Here again, by not having the strut extend all the way from the top rail inner surface to the top rail outer surface, a reduction in material is realized. The inner surfaces of the top and bottom rails are not necessarily flat surfaces and may include edges, holes, surface texture, etc.

In some embodiments, the particular arrangement of a combined strut which includes first and second struts is selected by analyzing the stresses which occur in test struts under loading. Certain areas of a strut may be under tension while other areas experience compression and/or shear forces. After identifying regions of a strut which show limited or no stresses under loading, a strut can be designed which no longer includes those regions. The identification of the lower stress regions can be performed using finite element analysis or any other suitable method.

For example, the identified regions which are "removed" from an analyzed strut and not included in the final strut may be the gaps between the inner surfaces of the rails and the inwardly-facing surfaces of the strut as described above. Additionally, as described below with reference to FIGS. 6-7, the outwardly-facing portions of one or more struts may have reduced volumes of materials as well.

Figure 5:
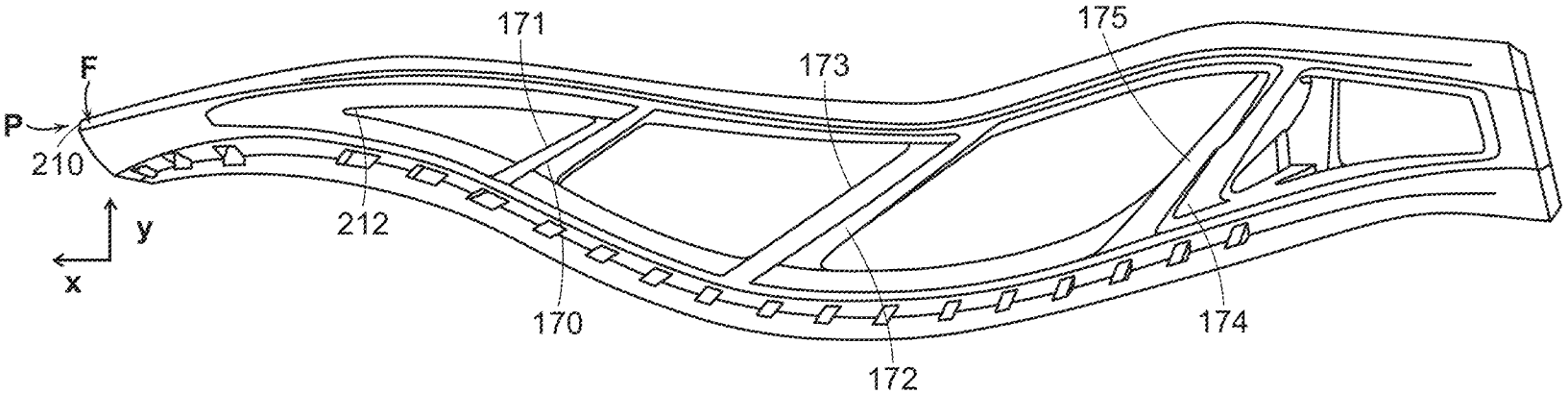
FIG. 5 is a side view of the lacrosse head shown in FIG. 1.

FIG. 5 is a side view of one embodiment of a lacrosse head and is used to show how the struts react to an application of force to the scoop in some embodiments. A force applied to the scoop in the direction that results from taking a shot or making a pass is shown with arrow F. The more distal strut of each pair of connected struts, i.e., the strut that is located closer to the scoop end of the head (struts 171, 173, and 175) is placed in compression, and each of the more proximal struts, i.e., each of struts 170, 172 and 174, is tensioned.

By pairing a distal strut with a proximal strut such that they abut one another, various advantages may be realized. As already mentioned above, such an arrangement may reduce the rail/strut connection locations where stress concentrations may lead to fatigue failure. Additionally, each strut may support the other to limit lateral deflections or buckling. Each strut also may provide additional compressive or tensile strength to the other strut when needed.

A collapsing core injection molding method may be used in some embodiments to manufacture various lacrosse heads disclosed herein. By using a collapsing core injection molding technique, a first strut can have an outward slant relative to vertical while a second strut can have an inward slant relative to vertical.

Figure 6:
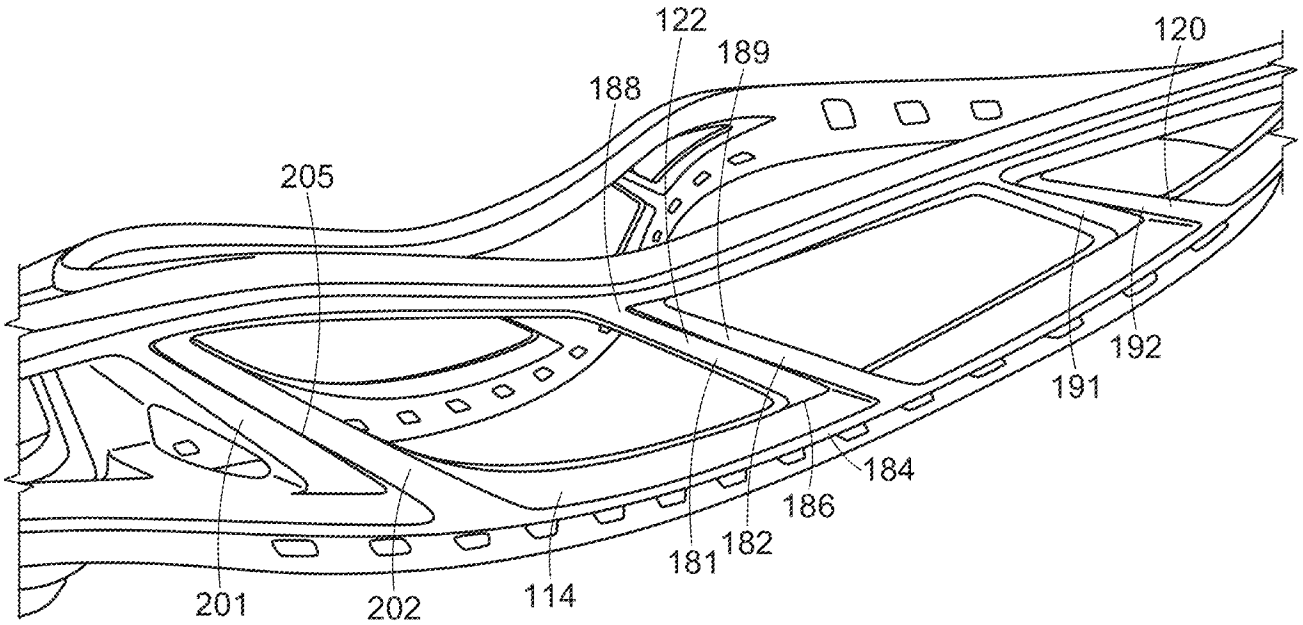
FIG. 6 shows the outer surfaces of struts shown in FIG. 1.

The struts of the present disclosure may include outwardly-facing surfaces which have a similar arrangement to the inwardly-facing surfaces. For example, as shown in FIG. 6, combined strut 120 and combined strut 122 each include first and second struts with outwardly-facing surfaces 181, 182, 191, 192. First outwardly-facing surface 181 of strut 122 connects to bottom rail 114 at a connection location 186 which is set back from an outer surface 184 of the bottom rail. That is, the connection location 186 is closer to the vertical centerline plane of the head than the outer surface 184 of the bottom rail.

The connection location 186 of the first outwardly-facing surface 181 to the bottom rail is set back farther from the bottom rail outer surface a greater distance than the setback of a connection location 188 of the first outwardly-facing surface 181 to the top rail. The opposite is true of second outwardly-facing surface 182. Here, the connection location to the bottom rail is at the outer surface of the bottom rail, while the connection location at the top rail is set back from the outer surface of the top rail toward the inner part of the head.

The first outwardly-facing surface 181 meets with the second outwardly-facing surface 182 at a cross-over location 189 at the approximate midpoint between the top and bottom rails where the first and second struts cross over one another.

The first and second struts of combined strut 120 near the distal end of the head also cross over one another and create the outwardly-facing surfaces 191, 192 which have a similar arrangement to outwardly-facing surfaces 181, 182.

While third strut 124 does not have similar inwardly-facing surfaces as first and second struts 120, 122, third strut 124 does have first outwardly-facing surfaces 201, 202 which connect at different setback distances from the outer surface of the bottom rail. A cross-over location 205 of the two outwardly-facing surfaces 201, 202 occurs closer to the bottom rail than the top rail in the illustrated embodiment.

Figure 7:
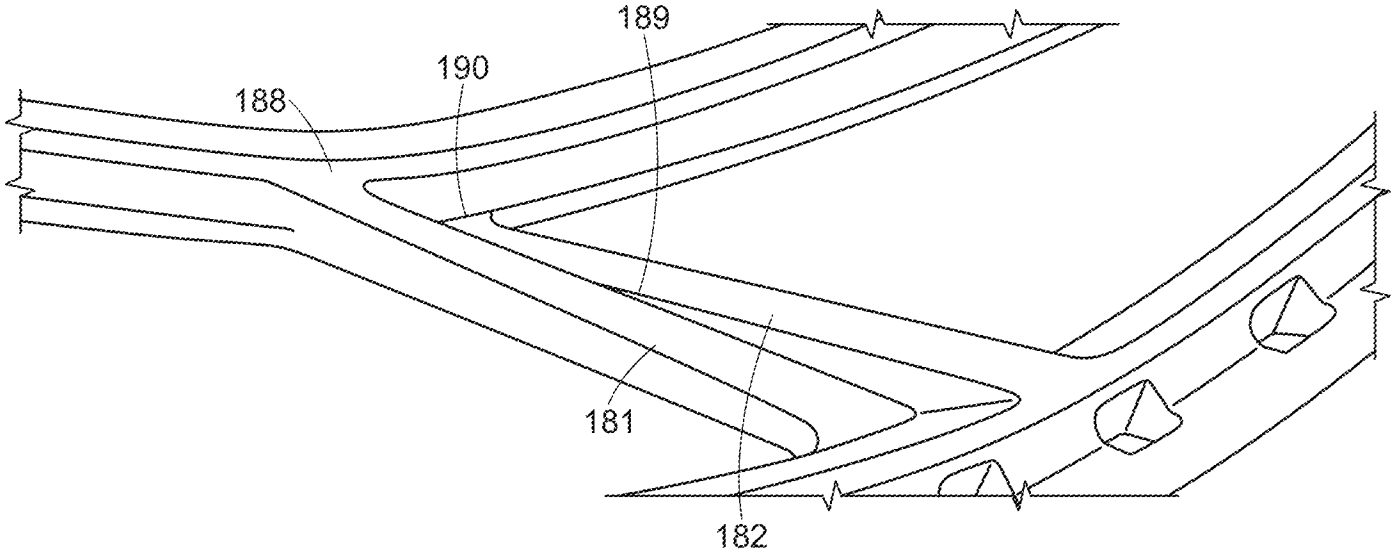
FIG. 7 shows the outer surfaces of one of the struts shown in FIG. 6

FIG. 7 is an enlarged view of first and second struts 181, 182 (see FIG. 6) viewed from below the lacrosse head. From this viewpoint, a connection location 190 of second strut 182 to top rail 110 is visible.

Figure 8:
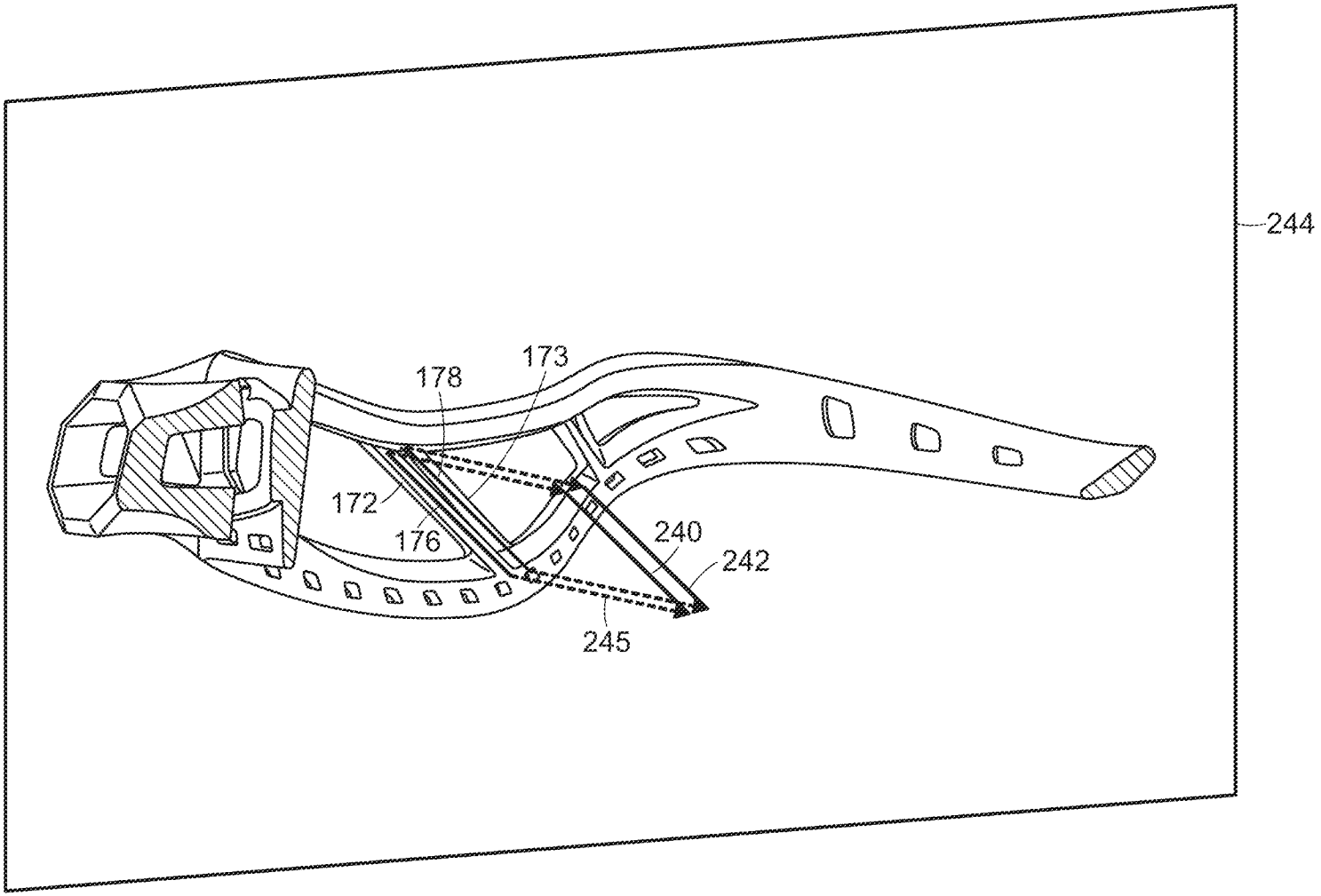
FIG. 8 shows a diagram of a projection of the longitudinal axes of two struts onto a vertical centerline plane.

In some embodiments, the first and second struts of a combined strut are arranged such that the first strut has a substantially similar angle about an axis that is normal to the vertical centerline plane. That is, an orthogonal projection of the first strut onto the vertical centerline plane is substantially parallel to an orthogonal projection of the second strut onto the vertical centerline plane. FIG. 8 shows a diagram of orthogonal projections 240, 242 of first and second longitudinal axes 176, 178 of first and second struts 170, 172 onto an imaginary vertical centerline plane 244. The orthogonal projections are parallel in the illustrated embodiment, and therefore have a same angle relative to an axis 245 that is normal to the vertical centerline plane 244.

While the orthogonal projections are substantially parallel to each other, the first and second struts 170, 172 are not parallel in three dimensions because the struts cross over one another. In some embodiments, the struts cross over one another to form an angle of between three and forty degrees. In some embodiments, an angle of between ten and twenty degrees is formed. The angle formed by the crossing over of the struts may be between twelve and eighteen degrees in some embodiments.

In some embodiments, the first and second struts contact each other at least at a crossover location, while in other embodiments, the struts are separated from one another. In embodiments where the struts are separated, orthogonal projections of the longitudinal axes of the first and second struts onto the vertical centerline plane may overlap, but the struts are thin enough to avoid contacting each other. For purposes herein, a strut longitudinal axis is defined as the centroidal axis of the strut.

The struts shown in FIGS. 1-10 are substantially linear in at least the ball stop end-to-scoop end direction. That is, projections of the struts on the vertical centerline plane result in substantially linear projections. For the embodiments illustrated therein, each individual strut is substantially linear (e.g., first strut 161) in the forward-backward direction, and each combined strut is substantially linear (e.g., strut 122). From a front view of the lacrosse head, the struts may be curved as they track the path of the sidewall, or they may be linear if they track a portion of the path of the sidewall that is linear. In some embodiments, some or all of the struts are curved in the forward-backward direction.

Various surfaces of the struts may be flat. For example, as can be seen in the cross-section of first and second struts 141, 142 of unitary strut 122 in FIG. 9, second strut 142 has a surface 220 which is both upwardly-facing and forwardly-facing, and which is flat from an innermost edge 224 of the surface 220 to an outermost edge 226 of the second strut 142. Similarly, first strut 141 has a surface 222 which is both rearwardly-facing and downwardly-facing, and which is flat from an innermost edge 228 of the first strut 141 to an outermost edge 229 of the first strut. In other embodiments, these surfaces may be curved or may include peaks or valleys.

Figure 10:
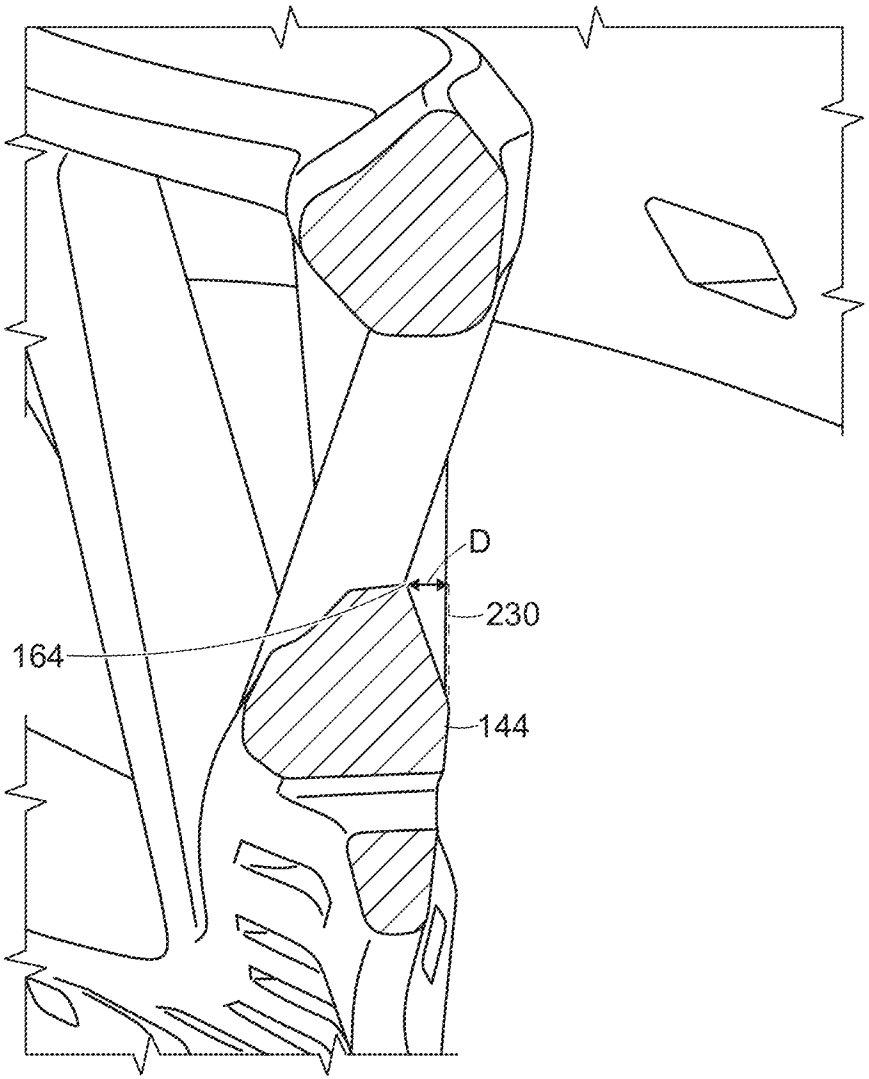
FIG. 10 is a cross-section view of a strut arrangement according to one embodiment.

FIG. 10 shows in cross-section how connection location164 of strut 162 is set back from inner surface 144 of bottom rail 114. An imaginary vertical plane 230 extends upwardly from inner surface 144. Connection location 164 is set back from vertical plane 230 by a distance D.

Any suitable material or materials may be used to form the lacrosse heads disclosed herein or components thereof. In some embodiments, a plastic suitable for use with injection molding may be used.

Table 1 below shows the results of a finite element analysis of deflections of models of three lacrosse heads. The model of the Optik Universal head does not include the strut arrangements disclosed herein, and the first material was modeled as Plastic A. The Crossing Struts head is modeled to include the struts and overall head arrangement as shown in FIG. 1, and includes two different modeled heads in terms of material: the same material as the modeled Optik (Plastic A); and Plastic B. Forces were modeled as being applied in three separate manners for each of three analyses: (1) a pass/shot force on the scoop in the direction of arrow F in FIG. 5; (2) a poke force on the scoop in the direction of arrow P in FIG. 5; and (3) a force on the sidewall perpendicular to the sheet at a transition point 212 in FIG. 5. Each force was modeled at 45N. Displacements were analyzed at two locations: a top of the scoop 210; and at a transition point 212 where the sidewall transitions to the scoop (see FIG. 5). Analysis results of the displacements in the x, y, and z directions are provided in Table 1. In FIG. 5, the z-axis is into the page.

TABLE 1

| | Optik Universal Head | Crossing Struts Head Material | |
|---|---|---|---|
| | Plastic A | Plastic A | Plastic B |
| | | Weight | |
| | 133.675 g | 138.7 g | 138.7 g |
| (1) Pass/Shot Force applied to Scoop | | | |
| Displacement top (Total) - mm | 30.195 | 29.455 | 19.072 |
| (x) | 0.744 | 2.051 | 1.328 |
| (y) | −30.186 | −29.384 | −19.025 |
| (z) | 0.006 | −0.052 | −0.034 |
| Displacement side (Total) - mm | 11.614 | 10.317 | 6.68 |
| (x) | 2.503 | 3.029 | 1.961 |
| (y) | −10.275 | −8.279 | −5.36 |
| (z) | 4.8 | 5.361 | 3.471 |
| (2) Poke Force applied to Scoop | | | |
| Poke Displacement top (Total) - mm | 3.88 | 5.823 | 3.77 |
| (x) | −3.48 | −4.916 | −3.183 |
| (y) | 1.715 | 3.121 | 2.021 |
| (z) | 0.018 | 0.013 | 0.008 |
| Poke Displacement side (Total) -mm | 2.648 | 3.69 | 2.389 |
| (x) | −0.85 | −1.194 | −0.779 |
| (y) | −0.68 | −0.758 | −0.491 |
| (z) | −2.414 | −3.409 | −2.207 |
| (3) Force applied to Sidewall | | | |
| Displacement top (Total) - mm | 55.952 | 50.646 | 32.792 |
| (x) | 2.672 | 3.221 | 2.085 |
| (y) | −2.684 | −4.92 | −3.186 |
| (z) | 55.823 | 50.303 | 32.57 |
| Displacement side (Total) - mm | 50.544 | 47.044 | 30.46 |
| (x) | 16.048 | 15.117 | 9.788 |
| (y) | −0.932 | 3.057 | 1.979 |
| (z) | 47.919 | 44.44 | 28.777 |

When comparing the head without the crossing struts to the head with the crossing struts, a significant difference in the displacement of the head in the y direction is noticeable when a pass or shot force is modeled. For example, the y-direction displacement of the head at the sidewall (transition point 212) is almost 20% when using the same material (−8.279 v. −10.275). The weight difference between the two heads when using the same material is attributable to an increased throat size of the modeled crossing struts head relative to the modeled non-crossing struts head.

The below chart shows the results of calculated stiffnesses based on physical measurements with an Instron® testing machine. The sidewall and scoop stiffnesses are significantly higher for the head with the crossing struts as compared to the head without the crossing struts that is made of the same material.

| Model | Pokecheck Stiffness (mPa) | Sidewall Stiffness (mPa) | Scoop (Shooting) Stiffness (mPa) |
|---|---|---|---|
| Tactik (Plastic A) | 124.37 | 17.88 | 19.67 |
| Tactik (Plastic A) | 127.6 | 18.01 | 19.42 |
| Tactik (Plastic A) | 128.54 | 18.04 | 19.32 |
| Tactik (Plastic A) | 127.26 | 17.89 | 19.55 |
| Tactik (Plastic A) | 132.53 | 18.21 | 19.38 |
| Optik U (Plastic B) | 167.15 | 17.53 | 19.18 |
| Optik U (Plastic A) | 158.56 | 16.56 | 17.07 |

The above aspects and embodiments may be employed in any suitable combination, as the present invention is not limited in this respect.

Having thus described several aspects of at least one embodiment of this invention, it is to be appreciated that various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A lacrosse head comprising:

a scoop region, a ball stop region, and first and second sidewalls, wherein the first sidewall includes a top rail and a bottom rail, the first sidewall top rail has an elongated top rail outer surface and an elongated top rail inner surface, each of the elongated top rail outer surface and the elongated top rail inner surface extending in a direction from the ball stop region toward the scoop region along a length of the top rail, and the first sidewall bottom rail has an elongated bottom rail outer surface and an elongated bottom rail inner surface, each of the elongated bottom rail outer surface and the elongated bottom rail inner surface extending in a direction from the ball stop region toward the scoop region along a length of the bottom rail;

a first unitary strut connected to the top rail and the bottom rail, the first unitary strut having first and second inwardly-facing surfaces facing generally toward an interior of the head; wherein the first inwardly-facing strut surface connects to the top rail at a first inner connection location and connects to the bottom rail at a second inner connection location;

the first inner connection location is positioned outwardly from the top rail inner surface by a straight line distance $d_1$, distance $d_1$ being the distance from the first inner connection location to a first imaginary vertical plane which contacts an innermost portion of the top rail inner surface at a lengthwise location of the first inner connection location, and distance $d_1$ being measured in a direction perpendicular to the first imaginary vertical plane;

the second inner connection location is positioned either at the bottom rail inner surface or outwardly from the bottom rail inner surface by a straight line distance $d_2$, distance $d_2$ being the distance from the second inner connection location to a second imaginary vertical plane which contacts an innermost portion of the bottom rail inner surface at a lengthwise location of the second inner connection location, and distance $d_2$ being measured in a direction perpendicular to the second imaginary vertical plane, the distance $d_2$ being less than distance $d_1$;

the second inwardly-facing strut surface connects to the top rail at a third inner connection location and connects to the bottom rail at a fourth inner connection location;

the fourth inner connection location is positioned outwardly from the bottom rail inner surface by a straight line distance $d_4$, distance $d_4$ being the distance from the fourth inner connection location to the second imaginary vertical plane at a lengthwise location of the fourth inner connection, and distance $d_4$ being measured in a direction perpendicular to the second imaginary vertical plane; and the third inner connection location is positioned either at the top rail inner surface or outwardly from the top rail inner surface by a horizontal straight line distance $d_3$, distance $d_3$ being the distance from the third inner connection location to the first imaginary vertical plane at a lengthwise location of the third inner connection, and distance $d_3$ being measured in a direction perpendicular to the first imaginary vertical plane, the distance $d_3$ being less than distance $d_4$.

2. A lacrosse head as in claim 1, wherein the first unitary strut comprises first and second struts which are connected to one another along at least fifty percent of the length of the first strut.

3. A lacrosse head as in claim 2, wherein the first and second struts are connected to one another along the entire length of the first strut.

4. A lacrosse head as in claim 1, wherein the second sidewall includes a top rail and a bottom rail, the second sidewall top rail has a second elongated top rail outer surface and a second elongated top rail inner surface, each of the second elongated top rail inner surface and the second elongated top rail outer surface extending in a direction from the ball stop region toward the scoop region along a length of the second sidewall top rail, and the second sidewall bottom rail has a second elongated bottom rail outer surface and a second elongated bottom rail inner surface, each of the second elongated bottom rail inner surface and the second elongated bottom rail outer surface extending in a direction from the ball stop region toward the scoop region along a length of the bottom rail;

a second unitary strut connected to the top rail and the bottom rail of the second sidewall, the second unitary strut having third and fourth inwardly-facing surfaces facing generally toward the interior of the head; wherein the third inwardly-facing strut surface connects to the top rail of the second sidewall at a fifth inner connection location and connects to the bottom rail of the second sidewall at a sixth inner connection location;

the fifth inner connection location is positioned outwardly from the second sidewall top rail inner surface by a straight line distance $d_5$, distance $d_5$ being the distance from the fifth inner connection location to a fifth imaginary vertical plane which contacts an innermost portion of the second sidewall top rail inner surface at a lengthwise location of the fifth inner connection location, and distance $d_5$ being measured in a direction perpendicular to the fifth imaginary vertical plane;

the sixth inner connection location is positioned either at the second sidewall bottom rail inner surface or outwardly from the second sidewall bottom rail inner surface by a straight line distance $d_6$, distance $d_6$ being the distance from the sixth inner connection location to a sixth imaginary vertical plane which contacts an innermost portion of the second sidewall bottom rail inner surface at a lengthwise location of the sixth inner connection location, and distance $d_6$ being measured in a direction perpendicular to the sixth imaginary vertical plane, the distance $d_6$ being less than distance $d_5$;

the fourth inwardly-facing strut surface connects to the second sidewall top rail at a seventh inner connection location and connects to the second sidewall bottom rail at an eighth inner connection location;

the eighth inner connection location is positioned outwardly from the second sidewall bottom rail inner surface by a straight line distance $d_8$, distance $d_8$ being the distance from the eighth inner connection location to an eighth imaginary vertical plane which contacts an innermost portion of the second sidewall bottom rail inner surface at a lengthwise location of the eighth inner connection location, and distance $d_8$ being measured in a direction perpendicular to the eighth imaginary vertical plane; and the seventh inner location is positioned either at the second sidewall top rail inner surface or outwardly from the second sidewall top rail inner surface by a straight line distance $d_7$, distance $d_7$ being the distance from the seventh inner connection location to a seventh imaginary vertical plane which contacts an innermost portion of the second sidewall top rail inner surface at a lengthwise location of the seventh inner connection location, and distance $d_7$ being measured in a direction perpendicular to the seventh imaginary vertical plane, the distance $d_7$ being that is less than distance $d_8$.

5. A lacrosse head as in claim 2, wherein the first and second struts are connected along an entirety of the length of at least one of the first and second struts.

6. A lacrosse head comprising:

a scoop region including a scoop end, a ball stop region including a ball stop end, and first and second sidewalls, wherein the first sidewall includes a top rail and a bottom rail, the sidewall top rail has an elongated top rail inner surface and an elongated top rail outer surface, each of the elongated top rail outer surface and the elongated top rail inner surface extending in a direction from the ball stop region toward the scoop region along a length of the top rail, and the sidewall bottom rail has an elongated bottom rail inner surface and has an elongated bottom rail outer surface, each of the elongated bottom rail outer surface and the elongated bottom rail inner surface extending in a direction from the ball stop region toward the scoop region along a length of the bottom rail;

the lacrosse head having an imaginary vertical centerline plane which extends longitudinally from the ball stop end to the scoop end;

a first strut connected to the top rail and the bottom rail, the first strut having an inwardly-facing surface which faces generally toward the imaginary vertical centerline plane and which connects to the top rail at a first inner connection location at a first lengthwise position of the top rail;

at the first lengthwise location, the first inner connection location is positioned outwardly from the top rail inner surface toward the top rail outer surface relative to the vertical centerline plane;

a second strut connected to the top rail and the bottom rail, the second strut having an inwardly-facing surface which faces generally toward the imaginary vertical centerline plane and which connects to the bottom rail at a second inner connection location at a second lengthwise position of the bottom rail; and at the second lengthwise location, the second inner connection location is positioned outwardly from the bottom rail inner surface toward the bottom rail outer surface relative to the vertical centerline plane; wherein the first and second struts are directly connected to one another within zero to five millimeters of the top rail and within zero to five millimeters of the bottom rail.

7. A lacrosse head as in claim 6, wherein the first and second struts are directly connected to one another along an entire length of at least one of the first and second struts.

8. A lacrosse head as in claim 6, wherein:

the bottom rail has an outer surface;

the first strut has an outwardly-facing surface which faces generally away from the imaginary vertical centerline plane and which connects to the bottom rail at a third inner connection location; and the third inner connection location is positioned inwardly away from the bottom rail outer surface toward the vertical centerline plane.

9. A lacrosse head as in claim 6, wherein:

the top rail has an outer surface;

the second strut has an outwardly-facing surface which faces generally away from the imaginary vertical centerline plane and which connects to the bottom rail at a fourth inner connection location; and the fourth inner connection location is positioned inwardly away from the bottom rail outer surface toward the vertical centerline plane.

10. A lacrosse head as in claim 6, wherein the first strut is linear.

11. A lacrosse head as in claim 10, wherein the second strut is linear.

12. A lacrosse head as in claim 6, wherein the first and second strut form a unitary strut.

13. A lacrosse head as in claim 6, the first and second struts are directly connected to one another at a connection of the first and second struts to the top rail.

14. A lacrosse head as in claim 13, wherein the first and second struts are directly connected to one another at a connection of the first and second struts to the bottom rail.

15. A lacrosse head as in claim 6, wherein the first and second struts are connected along at least fifty percent of the length of the first strut.

* * * * *